US008327931B2

(12) United States Patent
Agrawal et al.

(10) Patent No.: US 8,327,931 B2
(45) Date of Patent: Dec. 11, 2012

(54) MULTI-COMPONENT DISAPPEARING TRIPPING BALL AND METHOD FOR MAKING THE SAME

(75) Inventors: Gaurav Agrawal, Aurora, CO (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 310 days.

(21) Appl. No.: 12/633,677

(22) Filed: Dec. 8, 2009

(65) Prior Publication Data

US 2011/0132621 A1 Jun. 9, 2011

(51) Int. Cl.
*E21B 33/12* (2006.01)
*E21B 29/02* (2006.01)

(52) U.S. Cl. ..... 166/193; 166/376

(58) Field of Classification Search ..... 166/300, 166/376, 193, 153; 156/247, 248, 701–719; 277/331, 316; 428/576, 559
See application file for complete search history.

(56) References Cited

U.S. PATENT DOCUMENTS

| | | | | |
|---|---|---|---|---|
| 2,238,895 | A | 4/1941 | Gage | |
| 2,261,292 | A | 11/1941 | Salnikov | |
| 3,106,959 | A | 10/1963 | Huitt et al. | |
| 3,326,291 | A | 6/1967 | Zandmer et al. | |
| 3,390,724 | A | 7/1968 | Caldwell | |
| 3,513,230 | A | 5/1970 | Rhees et al. | |
| 3,637,446 | A * | 1/1972 | Elliott et al. | 156/69 |
| 3,645,331 | A * | 2/1972 | Maurer et al. | 175/65 |
| 3,775,823 | A * | 12/1973 | Adolph et al. | 75/235 |
| 3,894,850 | A * | 7/1975 | Kovalchuk et al. | 51/307 |
| 4,010,583 | A * | 3/1977 | Highberg | 451/42 |
| 4,039,717 | A | 8/1977 | Titus | |
| 4,157,732 | A | 6/1979 | Fonner | |
| 4,248,307 | A | 2/1981 | Silberman et al. | |
| 4,372,384 | A | 2/1983 | Kinney | |
| 4,373,584 | A | 2/1983 | Silberman et al. | |
| 4,374,543 | A | 2/1983 | Richardson | |
| 4,384,616 | A | 5/1983 | Dellinger | |
| 4,399,871 | A | 8/1983 | Adkins et al. | |
| 4,422,508 | A | 12/1983 | Rutledge, Jr. et al. | |
| 4,452,311 | A | 6/1984 | Speegle et al. | |
| 4,498,543 | A | 2/1985 | Pye et al. | |
| 4,499,048 | A | 2/1985 | Hanejko | |
| 4,499,049 | A | 2/1985 | Hanejko | |
| 4,534,414 | A | 8/1985 | Pringle | |
| 4,539,175 | A | 9/1985 | Lichti et al. | |
| 4,640,354 | A | 2/1987 | Boisson | |
| 4,673,549 | A | 6/1987 | Ecer | |

(Continued)

FOREIGN PATENT DOCUMENTS

EP 1798301 A1 8/2006

(Continued)

OTHER PUBLICATIONS

Merriam-Webster, definition of "dissolve", retrieved Jul. 9, 2012.*

(Continued)

*Primary Examiner* — Daniel P Stephenson
(74) *Attorney, Agent, or Firm* — Cantor Colburn LLP

(57) ABSTRACT

A tripping ball including two or more dissolution resistant parts of a ball and an adherent dissolvable material binding the two or more parts of the ball together. A method for making a tripping ball is also included.

34 Claims, 5 Drawing Sheets

U.S. PATENT DOCUMENTS

| | | | | |
|---|---|---|---|---|
| 4,674,572 | A | | 6/1987 | Gallus |
| 4,678,037 | A | | 7/1987 | Smith |
| 4,681,133 | A | | 7/1987 | Weston |
| 4,688,641 | A | | 8/1987 | Knieriemen |
| 4,693,863 | A | * | 9/1987 | Del Corso et al. ..... 419/13 |
| 4,703,807 | A | | 11/1987 | Weston |
| 4,706,753 | A | | 11/1987 | Ohkochi et al. |
| 4,708,202 | A | | 11/1987 | Sukup et al. |
| 4,708,208 | A | | 11/1987 | Halbardier |
| 4,709,761 | A | | 12/1987 | Setterberg, Jr. |
| 4,714,116 | A | | 12/1987 | Brunner |
| 4,716,964 | A | | 1/1988 | Erbstoesser et al. |
| 4,721,159 | A | | 1/1988 | Ohkochi et al. |
| 4,738,599 | A | | 4/1988 | Shilling |
| 4,741,973 | A | | 5/1988 | Condit et al. |
| 4,768,588 | A | | 9/1988 | Kupsa |
| 4,784,226 | A | | 11/1988 | Wyatt |
| 4,805,699 | A | | 2/1989 | Halbardier |
| 4,817,725 | A | | 4/1989 | Jenkins |
| 4,834,184 | A | | 5/1989 | Streich et al. |
| H635 | H | | 6/1989 | Johnson et al. |
| 4,850,432 | A | | 7/1989 | Porter et al. |
| 4,853,056 | A | * | 8/1989 | Hoffman ..... 156/147 |
| 4,869,324 | A | | 9/1989 | Holder |
| 4,869,325 | A | | 9/1989 | Halbardier |
| 4,889,187 | A | | 12/1989 | Terrell et al. |
| 4,890,675 | A | | 1/1990 | Dew |
| 4,909,320 | A | | 3/1990 | Hebert et al. |
| 4,929,415 | A | | 5/1990 | Okazaki |
| 4,932,474 | A | | 6/1990 | Schroeder, Jr. et al. |
| 4,944,351 | A | | 7/1990 | Eriksen et al. |
| 4,949,788 | A | | 8/1990 | Szarka et al. |
| 4,952,902 | A | * | 8/1990 | Kawaguchi et al. ..... 338/22 R |
| 4,975,412 | A | | 12/1990 | Okazaki et al. |
| 4,977,958 | A | | 12/1990 | Miller |
| 4,981,177 | A | | 1/1991 | Carmody et al. |
| 4,986,361 | A | | 1/1991 | Mueller et al. |
| 5,006,044 | A | | 4/1991 | Walker, Sr. et al. |
| 5,010,955 | A | | 4/1991 | Springer |
| 5,036,921 | A | | 8/1991 | Pittard et al. |
| 5,048,611 | A | | 9/1991 | Cochran |
| 5,049,165 | A | | 9/1991 | Tselesin |
| 5,063,775 | A | | 11/1991 | Walker, Sr. et al. |
| 5,074,361 | A | | 12/1991 | Brisco et al. |
| 5,084,088 | A | | 1/1992 | Okazaki |
| 5,090,480 | A | | 2/1992 | Pittard et al. |
| 5,095,988 | A | | 3/1992 | Bode |
| 5,103,911 | A | | 4/1992 | Heijnen |
| 5,117,915 | A | | 6/1992 | Mueller et al. |
| 5,161,614 | A | | 11/1992 | Wu et al. |
| 5,178,216 | A | | 1/1993 | Giroux et al. |
| 5,181,571 | A | | 1/1993 | Mueller et al. |
| 5,188,182 | A | | 2/1993 | Echols, III et al. |
| 5,188,183 | A | | 2/1993 | Hopmann et al. |
| 5,222,867 | A | | 6/1993 | Walker, Sr. et al. |
| 5,226,483 | A | | 7/1993 | Williamson, Jr. |
| 5,228,518 | A | | 7/1993 | Wilson et al. |
| 5,234,055 | A | | 8/1993 | Cornette |
| 5,252,365 | A | | 10/1993 | White |
| 5,253,714 | A | | 10/1993 | Davis et al. |
| 5,271,468 | A | | 12/1993 | Streich et al. |
| 5,282,509 | A | | 2/1994 | Schurr, III |
| 5,292,478 | A | | 3/1994 | Scorey |
| 5,293,940 | A | | 3/1994 | Hromas et al. |
| 5,309,874 | A | * | 5/1994 | Willermet et al. ..... 123/90.51 |
| 5,310,000 | A | | 5/1994 | Arterbury et al. |
| 5,380,473 | A | | 1/1995 | Bogue et al. |
| 5,392,860 | A | | 2/1995 | Ross |
| 5,394,941 | A | | 3/1995 | Venditto et al. |
| 5,398,754 | A | | 3/1995 | Dinhoble |
| 5,407,011 | A | | 4/1995 | Layton |
| 5,411,082 | A | | 5/1995 | Kennedy |
| 5,417,285 | A | | 5/1995 | Van Buskirk et al. |
| 5,425,424 | A | | 6/1995 | Reinhardt et al. |
| 5,427,177 | A | | 6/1995 | Jordan, Jr. et al. |
| 5,435,392 | A | | 7/1995 | Kennedy |
| 5,439,051 | A | | 8/1995 | Kennedy et al. |
| 5,454,430 | A | | 10/1995 | Kennedy et al. |
| 5,456,317 | A | | 10/1995 | Hood, III et al. |
| 5,456,327 | A | | 10/1995 | Denton et al. |
| 5,464,062 | A | | 11/1995 | Blizzard, Jr. |
| 5,472,048 | A | | 12/1995 | Kennedy et al. |
| 5,474,131 | A | | 12/1995 | Jordan, Jr. et al. |
| 5,477,923 | A | | 12/1995 | Jordan, Jr. et al. |
| 5,479,986 | A | | 1/1996 | Gano et al. |
| 5,526,880 | A | | 6/1996 | Jordan, Jr. et al. |
| 5,526,881 | A | | 6/1996 | Martin et al. |
| 5,529,746 | A | | 6/1996 | Knoss et al. |
| 5,533,573 | A | | 7/1996 | Jordan, Jr. et al. |
| 5,536,485 | A | * | 7/1996 | Kume et al. ..... 423/446 |
| 5,558,153 | A | | 9/1996 | Holcombe et al. |
| 5,623,993 | A | | 4/1997 | Van Buskirk et al. |
| 5,623,994 | A | | 4/1997 | Robinson |
| 5,641,023 | A | | 6/1997 | Ross et al. |
| 5,647,444 | A | | 7/1997 | Williams |
| 5,677,372 | A | | 10/1997 | Yamamoto et al. |
| 5,707,214 | A | | 1/1998 | Schmidt |
| 5,709,269 | A | | 1/1998 | Head |
| 5,720,344 | A | | 2/1998 | Newman |
| 5,765,639 | A | | 6/1998 | Muth |
| 5,772,735 | A | * | 6/1998 | Sehgal et al. ..... 95/45 |
| 5,782,305 | A | | 7/1998 | Hicks |
| 5,797,454 | A | | 8/1998 | Hipp |
| 5,826,652 | A | | 10/1998 | Tapp |
| 5,826,661 | A | | 10/1998 | Parker et al. |
| 5,829,520 | A | | 11/1998 | Johnson |
| 5,836,396 | A | | 11/1998 | Norman |
| 5,857,521 | A | | 1/1999 | Ross et al. |
| 5,881,816 | A | | 3/1999 | Wright |
| 5,934,372 | A | | 8/1999 | Muth |
| 5,941,309 | A | * | 8/1999 | Appleton ..... 166/317 |
| 5,960,881 | A | | 10/1999 | Allamon et al. |
| 5,985,466 | A | | 11/1999 | Atarashi et al. |
| 5,990,051 | A | | 11/1999 | Ischy et al. |
| 5,992,452 | A | | 11/1999 | Nelson, II |
| 5,992,520 | A | | 11/1999 | Schultz et al. |
| 6,007,314 | A | | 12/1999 | Nelson, II |
| 6,024,915 | A | | 2/2000 | Kume et al. |
| 6,047,773 | A | | 4/2000 | Zeltmann et al. |
| 6,050,340 | A | | 4/2000 | Scott |
| 6,069,313 | A | * | 5/2000 | Kay ..... 136/249 |
| 6,076,600 | A | | 6/2000 | Vick, Jr. et al. |
| 6,079,496 | A | | 6/2000 | Hirth |
| 6,085,837 | A | | 7/2000 | Massinon et al. |
| 6,095,247 | A | | 8/2000 | Streich et al. |
| 6,119,783 | A | | 9/2000 | Parker et al. |
| 6,142,237 | A | | 11/2000 | Christmas et al. |
| 6,161,622 | A | | 12/2000 | Robb et al. |
| 6,167,970 | B1 | | 1/2001 | Stout et al. |
| 6,173,779 | B1 | | 1/2001 | Smith |
| 6,189,616 | B1 | | 2/2001 | Gano et al. |
| 6,189,618 | B1 | * | 2/2001 | Beeman et al. ..... 166/312 |
| 6,213,202 | B1 | | 4/2001 | Read, Jr. |
| 6,220,350 | B1 | | 4/2001 | Brothers et al. |
| 6,228,904 | B1 | | 5/2001 | Yadav et al. |
| 6,237,688 | B1 | | 5/2001 | Burleson et al. |
| 6,238,280 | B1 | * | 5/2001 | Ritt et al. ..... 451/540 |
| 6,241,021 | B1 | | 6/2001 | Bowling |
| 6,250,392 | B1 | | 6/2001 | Muth |
| 6,261,432 | B1 | | 7/2001 | Huber et al. |
| 6,273,187 | B1 | | 8/2001 | Voisin, Jr. et al. |
| 6,276,452 | B1 | | 8/2001 | Davis et al. |
| 6,276,457 | B1 | | 8/2001 | Moffatt et al. |
| 6,279,656 | B1 | | 8/2001 | Sinclair et al. |
| 6,287,445 | B1 | * | 9/2001 | Lashmore et al. ..... 205/144 |
| 6,302,205 | B1 | | 10/2001 | Ryll |
| 6,315,041 | B1 | | 11/2001 | Carlisle et al. |
| 6,315,050 | B2 | | 11/2001 | Vaynshteyn et al. |
| 6,325,148 | B1 | | 12/2001 | Trahan et al. |
| 6,328,110 | B1 | | 12/2001 | Joubert |
| 6,341,653 | B1 | | 1/2002 | Firmaniuk et al. |
| 6,341,747 | B1 | | 1/2002 | Schmidt et al. |
| 6,349,766 | B1 | | 2/2002 | Bussear et al. |
| 6,354,379 | B2 | | 3/2002 | Miszewski et al. |
| 6,371,206 | B1 | | 4/2002 | Mills |
| 6,382,244 | B2 | | 5/2002 | Vann |
| 6,390,195 | B1 | | 5/2002 | Nguyen et al. |

6,390,200 B1 5/2002 Allamon et al.
6,394,185 B1 5/2002 Constien
6,397,950 B1 6/2002 Streich et al.
6,403,210 B1 6/2002 Stuivinga et al.
6,408,946 B1 6/2002 Marshall et al.
6,419,023 B1 7/2002 George et al.
6,439,313 B1 8/2002 Thomeer et al.
6,457,525 B1 10/2002 Scott
6,467,546 B2 10/2002 Allamon et al.
6,470,965 B1 10/2002 Winzer
6,491,097 B1 12/2002 ONeal et al.
6,491,116 B2 12/2002 Berscheidt et al.
6,513,598 B2 2/2003 Moore et al.
6,540,033 B1 4/2003 Sullivan et al.
6,543,543 B2 4/2003 Muth
6,561,275 B2 5/2003 Glass et al.
6,588,507 B2 7/2003 Dusterhoft et al.
6,591,915 B2 7/2003 Burris et al.
6,601,648 B2 8/2003 Ebinger
6,601,650 B2 8/2003 Sundararajan
6,612,826 B1 9/2003 Bauer et al.
6,613,383 B1 9/2003 George et al.
6,619,400 B2 9/2003 Brunet
6,634,428 B2 10/2003 Krauss et al.
6,662,886 B2 12/2003 Russell
6,675,889 B1 1/2004 Mullins et al.
6,713,177 B2 3/2004 George et al.
6,715,541 B2 4/2004 Pedersen et al.
6,719,051 B2 4/2004 Hailey, Jr. et al.
6,755,249 B2 6/2004 Robison et al.
6,776,228 B2 8/2004 Pedersen et al.
6,779,599 B2 8/2004 Mullins et al.
6,799,638 B2 10/2004 Butterfield, Jr.
6,810,960 B2 11/2004 Pia
6,817,414 B2 11/2004 Lee
6,831,044 B2 12/2004 Constien
6,883,611 B2 4/2005 Smith et al.
6,887,297 B2 * 5/2005 Winter et al. ..... 75/369
6,896,061 B2 5/2005 Hriscu et al.
6,899,176 B2 5/2005 Hailey, Jr. et al.
6,913,827 B2 7/2005 George et al.
6,926,086 B2 8/2005 Patterson et al.
6,932,159 B2 8/2005 Hovem
6,939,388 B2 9/2005 Angeliu
6,945,331 B2 9/2005 Patel
6,959,759 B2 11/2005 Doane et al.
6,973,970 B2 12/2005 Johnston et al.
6,973,973 B2 12/2005 Howard et al.
6,983,796 B2 1/2006 Bayne et al.
6,986,390 B2 1/2006 Doane et al.
7,013,989 B2 3/2006 Hammond et al.
7,013,998 B2 3/2006 Ray et al.
7,017,664 B2 3/2006 Walker et al.
7,017,677 B2 3/2006 Keshavan et al.
7,021,389 B2 4/2006 Bishop et al.
7,025,146 B2 4/2006 King et al.
7,028,778 B2 4/2006 Krywitsky
7,044,230 B2 5/2006 Starr et al.
7,049,272 B2 5/2006 Sinclair et al.
7,051,805 B2 5/2006 Doane et al.
7,059,410 B2 6/2006 Bousche et al.
7,090,027 B1 8/2006 Williams
7,093,664 B2 8/2006 Todd et al.
7,096,945 B2 8/2006 Richards et al.
7,108,080 B2 9/2006 Tessari et al.
7,111,682 B2 9/2006 Blaisdell
7,150,326 B2 12/2006 Bishop et al.
7,163,066 B2 1/2007 Lehr
7,168,494 B2 1/2007 Starr et al.
7,174,963 B2 2/2007 Bertelsen
7,182,135 B2 2/2007 Szarka
7,210,527 B2 5/2007 Walker et al.
7,210,533 B2 5/2007 Starr et al.
7,234,530 B2 6/2007 Gass
7,250,188 B2 7/2007 Dodelet et al.
7,255,172 B2 8/2007 Johnson
7,255,178 B2 8/2007 Slup et al.
7,264,060 B2 9/2007 Wills
7,267,178 B2 9/2007 Krywitsky
7,270,186 B2 9/2007 Johnson
7,287,592 B2 10/2007 Surjaatmadja et al.
7,311,152 B2 12/2007 Howard et al.
7,320,365 B2 1/2008 Pia
7,322,412 B2 1/2008 Badalamenti et al.
7,322,417 B2 1/2008 Rytlewski et al.
7,325,617 B2 2/2008 Murray
7,328,750 B2 2/2008 Swor et al.
7,331,388 B2 2/2008 Vilela et al.
7,337,854 B2 3/2008 Horn et al.
7,346,456 B2 3/2008 Le Bemadjiel
7,350,582 B2 4/2008 McKeachnie et al.
7,353,879 B2 4/2008 Todd et al.
7,360,593 B2 4/2008 Constien
7,360,597 B2 4/2008 Blaisdell
7,363,970 B2 4/2008 Corre et al.
7,387,165 B2 6/2008 Lopez de Cardenas et al.
7,401,648 B2 7/2008 Richard
7,416,029 B2 8/2008 Telfer et al.
7,426,964 B2 9/2008 Lynde et al.
7,441,596 B2 * 10/2008 Wood et al. ..... 166/179
7,445,049 B2 11/2008 Howard et al.
7,451,815 B2 11/2008 Hailey, Jr.
7,451,817 B2 11/2008 Reddy et al.
7,461,699 B2 12/2008 Richard et al.
7,464,764 B2 12/2008 Xu
7,472,750 B2 1/2009 Walker et al.
7,478,676 B2 1/2009 East, Jr. et al.
7,503,399 B2 3/2009 Badalamenti et al.
7,509,993 B1 3/2009 Turng et al.
7,510,018 B2 3/2009 Williamson et al.
7,513,311 B2 4/2009 Gramstad et al.
7,527,103 B2 5/2009 Huang et al.
7,552,777 B2 6/2009 Murray et al.
7,552,779 B2 6/2009 Murray
7,559,357 B2 7/2009 Clem
7,575,062 B2 8/2009 East, Jr.
7,579,087 B2 8/2009 Maloney et al.
7,591,318 B2 9/2009 Tilghman
7,600,572 B2 10/2009 Slup et al.
7,604,049 B2 10/2009 Vaidya et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,511 B2 4/2010 Buyers et al.
7,708,078 B2 5/2010 Stoesz
7,709,421 B2 5/2010 Jones et al.
7,712,541 B2 5/2010 Loretz et al.
7,726,406 B2 6/2010 Xu
7,757,773 B2 7/2010 Rytlewski
7,762,342 B2 7/2010 Richard et al.
7,770,652 B2 8/2010 Barnett
7,775,284 B2 8/2010 Richards et al.
7,775,286 B2 8/2010 Duphorne
7,784,543 B2 8/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,855,168 B2 12/2010 Fuller et al.
7,861,781 B2 1/2011 D'Arcy
7,874,365 B2 1/2011 East, Jr. et al.
7,878,253 B2 2/2011 Stowe et al.
7,896,091 B2 3/2011 Williamson et al.
7,897,063 B1 3/2011 Perry et al.
7,900,696 B1 3/2011 Nish et al.
7,900,703 B2 3/2011 Clark et al.

7,909,096 B2 3/2011 Clark et al.
7,909,104 B2 3/2011 Bjorgum
7,909,110 B2 3/2011 Sharma et al.
7,913,765 B2 3/2011 Crow et al.
7,931,093 B2 4/2011 Foster et al.
7,938,191 B2 5/2011 Vaidya
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0066572 A1 6/2002 Muth
2002/0104616 A1* 8/2002 De et al. ..... 156/344
2002/0136904 A1* 9/2002 Glass et al. ..... 428/426
2002/0162661 A1 11/2002 Krauss et al.
2003/0037925 A1 2/2003 Walker et al.
2003/0075326 A1 4/2003 Ebinger
2003/0111728 A1* 6/2003 Thai et al. ..... 257/735
2003/0141060 A1 7/2003 Hailey et al.
2003/0141061 A1 7/2003 Hailey et al.
2003/0141079 A1 7/2003 Doane et al.
2003/0150614 A1* 8/2003 Brown et al. ..... 166/286
2003/0155114 A1 8/2003 Pedersen et al.
2003/0155115 A1 8/2003 Pedersen et al.
2003/0159828 A1 8/2003 Howard et al.
2003/0164237 A1 9/2003 Butterfield
2003/0183391 A1 10/2003 Hriscu et al.
2004/0005483 A1* 1/2004 Lin ..... 428/702
2004/0020832 A1 2/2004 Richards et al.
2004/0045723 A1 3/2004 Slup et al.
2004/0089449 A1 5/2004 Walton et al.
2004/0159428 A1 8/2004 Hammond et al.
2004/0182583 A1 9/2004 Doane et al.
2004/0231845 A1 11/2004 Cooke
2004/0256109 A1 12/2004 Johnson
2004/0256157 A1 12/2004 Tessari et al.
2005/0034876 A1 2/2005 Doane et al.
2005/0051329 A1 3/2005 Blaisdell
2005/0161212 A1 7/2005 Leismer et al.
2005/0161224 A1 7/2005 Starr et al.
2005/0194143 A1 9/2005 Xu et al.
2005/0205264 A1 9/2005 Starr et al.
2005/0205265 A1 9/2005 Todd et al.
2005/0205266 A1 9/2005 Todd et al.
2005/0241824 A1 11/2005 Burris, II et al.
2005/0241825 A1 11/2005 Burris, II et al.
2005/0257936 A1 11/2005 Lehr
2006/0012087 A1* 1/2006 Matsuda et al. ..... 264/619
2006/0045787 A1 3/2006 Jandeska et al.
2006/0057479 A1* 3/2006 Niimi et al. ..... 430/59.4
2006/0081378 A1 4/2006 Howard et al.
2006/0102255 A1* 5/2006 Woodfield et al. ..... 148/421
2006/0102871 A1 5/2006 Wang et al.
2006/0108126 A1 5/2006 Horn et al.
2006/0110615 A1 5/2006 Karim et al.
2006/0124310 A1 6/2006 Lopez de Cardenas
2006/0124312 A1 6/2006 Rytlewski et al.
2006/0131011 A1 6/2006 Lynde et al.
2006/0131031 A1 6/2006 McKeachnie et al.
2006/0144515 A1* 7/2006 Tada et al. ..... 156/344
2006/0151178 A1 7/2006 Howard et al.
2006/0162927 A1 7/2006 Walker et al.
2006/0213670 A1 9/2006 Bishop et al.
2006/0231253 A1 10/2006 Vilela et al.
2006/0283592 A1 12/2006 Sierra et al.
2007/0017674 A1 1/2007 Blaisdell
2007/0017675 A1 1/2007 Hammami et al.
2007/0029082 A1 2/2007 Giroux et al.
2007/0039741 A1 2/2007 Hailey
2007/0044958 A1* 3/2007 Rytlewski et al. ..... 166/250.01
2007/0044966 A1 3/2007 Davies et al.
2007/0051521 A1 3/2007 Fike et al.
2007/0054101 A1 3/2007 Sigalas et al.
2007/0057415 A1 3/2007 Katagiri et al.
2007/0062644 A1* 3/2007 Nakamura et al. ..... 156/344
2007/0074873 A1 4/2007 McKeachnie et al.
2007/0107908 A1* 5/2007 Vaidya et al. ..... 166/376
2007/0119600 A1 5/2007 Slup et al.
2007/0131912 A1* 6/2007 Simone et al. ..... 252/500
2007/0151009 A1* 7/2007 Conrad et al. ..... 4/300.3
2007/0151769 A1 7/2007 Slutz et al.
2007/0169935 A1* 7/2007 Akbar et al. ..... 166/284
2007/0181224 A1 8/2007 Marya et al.
2007/0185655 A1 8/2007 Le Bemadjiel
2007/0187095 A1 8/2007 Walker et al.
2007/0221373 A1* 9/2007 Murray ..... 166/192
2007/0221384 A1 9/2007 Murray
2007/0259994 A1 11/2007 Tour et al.
2007/0261862 A1* 11/2007 Murray ..... 166/386
2007/0272411 A1 11/2007 Lopez De Cardenas et al.
2007/0272413 A1 11/2007 Rytlewski et al.
2007/0277979 A1 12/2007 Todd et al.
2007/0284109 A1 12/2007 East et al.
2008/0020923 A1 1/2008 Debe et al.
2008/0047707 A1* 2/2008 Boney et al. ..... 166/270
2008/0060810 A9 3/2008 Nguyen et al.
2008/0066923 A1 3/2008 Xu
2008/0066924 A1 3/2008 Xu
2008/0078553 A1 4/2008 George
2008/0081866 A1 4/2008 Gong et al.
2008/0099209 A1 5/2008 Loretz et al.
2008/0105438 A1 5/2008 Jordan et al.
2008/0115932 A1 5/2008 Cooke
2008/0121436 A1 5/2008 Slay et al.
2008/0127475 A1 6/2008 Griffo
2008/0149325 A1 6/2008 Crawford
2008/0149345 A1 6/2008 Marya
2008/0149351 A1 6/2008 Marya et al.
2008/0169105 A1 7/2008 Williamson et al.
2008/0179104 A1 7/2008 Zhang et al.
2008/0202764 A1 8/2008 Clayton et al.
2008/0223586 A1 9/2008 Barnett
2008/0223587 A1 9/2008 Cherewyk
2008/0236829 A1 10/2008 Lynde
2008/0248205 A1* 10/2008 Blanchet et al. ..... 427/282
2008/0277109 A1 11/2008 Vaidya
2008/0277980 A1 11/2008 Koda et al.
2008/0296024 A1 12/2008 Huang et al.
2008/0314581 A1 12/2008 Brown
2008/0314588 A1 12/2008 Langlais et al.
2009/0038858 A1 2/2009 Griffo et al.
2009/0044946 A1* 2/2009 Schasteen et al. ..... 166/319
2009/0044949 A1* 2/2009 King et al. ..... 166/332.4
2009/0084556 A1 4/2009 Richards et al.
2009/0084600 A1 4/2009 Severance
2009/0107684 A1 4/2009 Cooke, Jr.
2009/0145666 A1 6/2009 Radford et al.
2009/0152009 A1 6/2009 Slay et al.
2009/0159289 A1* 6/2009 Avant et al. ..... 166/316
2009/0178808 A1 7/2009 Williamson et al.
2009/0194273 A1 8/2009 Surjaatmadja et al.
2009/0205841 A1 8/2009 Kluge et al.
2009/0226340 A1 9/2009 Marya
2009/0242202 A1 10/2009 Rispler et al.
2009/0242208 A1 10/2009 Bolding
2009/0242214 A1 10/2009 Foster et al.
2009/0255667 A1 10/2009 Clem et al.
2009/0255686 A1 10/2009 Richard et al.
2009/0260817 A1 10/2009 Gambier et al.
2009/0272544 A1 11/2009 Giroux et al.
2009/0283270 A1 11/2009 Langeslag
2009/0301730 A1 12/2009 Gweily
2009/0308588 A1 12/2009 Howell et al.

| | | | |
|---|---|---|---|
| 2010/0015002 | A1 | 1/2010 | Barrera et al. |
| 2010/0032151 | A1 | 2/2010 | Duphorne |
| 2010/0044041 | A1 | 2/2010 | Smith et al. |
| 2010/0051278 | A1 | 3/2010 | Mytopher et al. |
| 2010/0089583 | A1 | 4/2010 | Xu et al. |
| 2010/0089587 | A1 | 4/2010 | Stout |
| 2010/0101803 | A1 | 4/2010 | Clayton et al. |
| 2010/0139930 | A1 | 6/2010 | Patel et al. |
| 2010/0200230 | A1 | 8/2010 | East, Jr. et al. |
| 2010/0236793 | A1 | 9/2010 | Bjorgum |
| 2010/0236794 | A1 | 9/2010 | Duan et al. |
| 2010/0243254 | A1 | 9/2010 | Murphy et al. |
| 2010/0252273 | A1 | 10/2010 | Duphorne |
| 2010/0252280 | A1 | 10/2010 | Swor et al. |
| 2010/0270031 | A1 | 10/2010 | Patel |
| 2010/0294510 | A1 | 11/2010 | Holmes |
| 2011/0005773 | A1 | 1/2011 | Dusterhoft et al. |
| 2011/0036592 | A1 | 2/2011 | Fay |
| 2011/0048743 | A1 | 3/2011 | Stafford et al. |
| 2011/0056692 | A1 | 3/2011 | Lopez de Cardenas et al. |
| 2011/0067872 | A1 | 3/2011 | Agrawal |
| 2011/0067889 | A1 | 3/2011 | Marya et al. |
| 2011/0067890 | A1 | 3/2011 | Themig |
| 2011/0100643 | A1 | 5/2011 | Themig et al. |
| 2011/0127044 | A1 | 6/2011 | Radford et al. |
| 2011/0132143 | A1 | 6/2011 | Xu et al. |
| 2011/0132612 | A1 | 6/2011 | Agrawal et al. |
| 2011/0132619 | A1 | 6/2011 | Agrawal et al. |
| 2011/0132620 | A1* | 6/2011 | Agrawal et al. ..... 166/376 |
| 2011/0132621 | A1 | 6/2011 | Agrawal et al. |
| 2011/0135530 | A1 | 6/2011 | Xu et al. |
| 2011/0135805 | A1 | 6/2011 | Doucet et al. |
| 2011/0135953 | A1 | 6/2011 | Xu et al. |
| 2011/0136707 | A1 | 6/2011 | Xu et al. |
| 2011/0139465 | A1 | 6/2011 | Tibbles et al. |
| 2011/0147014 | A1 | 6/2011 | Chen et al. |
| 2011/0186306 | A1 | 8/2011 | Marya et al. |
| 2011/0247833 | A1 | 10/2011 | Todd et al. |
| 2011/0253387 | A1 | 10/2011 | Ervin |
| 2011/0259610 | A1 | 10/2011 | Shkurti et al. |
| 2011/0277987 | A1 | 11/2011 | Frazier |
| 2011/0277989 | A1 | 11/2011 | Frazier |
| 2011/0284232 | A1 | 11/2011 | Huang |
| 2011/0284243 | A1 | 11/2011 | Frazier |

FOREIGN PATENT DOCUMENTS

| | | | |
|---|---|---|---|
| JP | 2000185725 | | 7/2000 |
| JP | 2004225084 | | 8/2004 |
| JP | 2004225765 | A | 8/2004 |
| JP | 2005076052 | A | 3/2005 |
| JP | 2010502840 | A | 1/2010 |
| WO | 2008/057045 | A1 | 5/2008 |
| WO | WO2008079485 | | 7/2008 |

OTHER PUBLICATIONS

International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.

Yi Feng, Hailong Yuan, "Electroless Plating of Carbon Nanotubes with Silver" Journal fo Materials Science, 39, (2004) pp. 3241-3243.

E. Flahaut et al., "Carbon Nanotube-Metal-Oxide Nanocomposites: Microstructure, Electrical Conductivity and Mechanical Properties" Acta amter. 48 (2000) 3803-3812.

C.S. Goh, J. Wei, L C Lee, and M. Gupta, "Development of novel carbon nanotube reinforced magnesium nanocomposites using the powder metallurgy technique", Nanottechnology 17 (2006) 7-12.

Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.

Xiaowu Nie, Patents of Methods to Prepare Intermetallic Matrix Composites: A Review, Recent Patents on Materials Science 2008, 1, 232-240, Department of Scientific Research, Hunan Railway College of Science and Technology, Zhuzhou, P.R. China.

Shimizu et al., "Multi-walled carbon nanotube-reinforced magnesium alloy composites", Scripta Materialia, vol. 58, Issue 4, pp. 267-270.

Jing Sun, Lian Gao, Wei Li, "Colloidal Processing fo Carbon Nanotube/Alumina Composites" Chem. Mater. 2002, 14, 5169-5172.

Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.

Y. Zhang and Hongjie Dai, "Formation of metal nanowires on suspended single-walled carbon nanotubes" Applied Physics Letter, vol. 77, No. 19 (2000), pp. 3015-3017.

Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.

Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.

Baker Hughes Tools. "Baker Oil Tools Introduces Revolutionary Sand Control Completion Technology," May 2, 2005.

E. Paul Bercegeay et al., "A One-Trip Gravel Packing System"; Society of Petroleum Engineers, Offshort Technology Conference, SPE Paper No. 4771; Feb. 7-8, 1974.

Bybee, Karen. "One-Trip Completion System Eliminates Perforations," COMPLETIONS TODAY, Sep. 2007, pp. 52-53.

Curtin, William and Brian Sheldon. "CNT-reinforced ceramics and metals," Materials Today, 2004, vol. 7, 44-49.

Galanty et al. "Consolidation of metal powders during the extrusion process," Journal of Materials Processing Technology (2002), pp. 491-496.

Hjortstam et al. "Can we achieve ultra-low resistivity in carbon nanotube-based metal composites," Applied Physics A (2004), vol. 78, Issue 8, pp. 1175-1179. [Abstract Only].

Notification of Transmittal of The International Search Report and the Written Opinion of the International Searching Authority; PCT/US2010/059259; International Searching Authority KIPO; Mailed Jun. 13, 2010.

Notification of Transmittal of The International Search Report and the Written Opinion of the International Searching Authority; PCT/US2010/059265; International Searching Authority KIPO; Mailed Jun. 16, 2011.

Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.

Song, G. and S. Song. "A Possible Biodegradable Magnesium Implant Material," Advanced Engineering Materials, vol. 9, Issue 4, Apr. 2007, pp. 298-302. [Abstract Only].

Zeng et al. "Progress and Challenge for Magnesium Alloys as Biomaterials," Advanced Engineering Materials, vol. 10, Issue 8, Aug. 2008, pp. B3-B14. [Abstract Only].

Notification of Transmittal of The International Search Report and the Written Opinion of the International Searching Authority; PCT/US2010/059257; Korean Intellectual Property Office; Mailed Jul. 27, 2011.

Notification of Transmittal of The International Search Report and the Written Opinion of the International Searching Authority; PCT/US2010/059268; International Searching Authority KIPO; Mailed Jun. 17, 2011.

Pardo, et al.; "Corrosion Behaviour of Magnesium/Aluminium Alloys in 3.5 wt% NaC1"; Corrosion Science; 50; pp. 823-834; (2008).

Notification of Transmittal of The International Search Report and Written Opinion, Mailed Jul. 8, 2011, International Appln. No. PCT/US2010/059263, Written Opinion 4 Pages, International Search Report 3 Pages.

Song, et al.; "Understanding Magnesium Corrosion"; Advanced Engineering Materials; 5; No. 12; pp. 837-858; (2003).

Abdoulaye Seyni, Nadine Le Bolay, Sonia Molina-Boisseau, "On the interest of using degradable fillers in co-ground composite materials", Powder Technology 190, (2009) pp. 176-184.

Ch. Christoglou, N. Voudouris, G.N. Angelopoulos, M. Pant, W. Dahl, "Deposition of Aluminum on Magnesium by a CVD Process", Surface and Coatings Technology 184 (2004) 149-155.
Constantin Vahlas, Brigitte Caussat, Philippe Serp, George N. Angelopoulos, "Principles and Applications of CVD Powder Technology", Materials Sciene and Engineering R 53 (2006) 1-72.
Guan Ling Song, Andrej Atrens "Corrosion Mechanisms of Magnesium Alloys", Advanced Engineering Materials 1999, 1, No. 1, pp. 11-33.
H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.
J. Dutta Majumdar, B. Ramesh Chandra, B.L. Mordike, R. Galun, I. Manna, "Laser Surface Engineering of a Magnesium Alloy with Al + Al2O3", Surface and Cotaings Technology 179 (2004) 297-305.
J.E. Gray, B. Luan, "Protective Coatings on Magnesuim and Its Alloys—a Critical Review", Journal of Alloys and Compounds 336 (2002) 88-113.
Yihua Zhu, Chunzhong Li, Qiufang Wu, "The process of coating on ultrafine particles by surface hydrolysis reaction in a fluidized bed reactor", Surface and Coatings Technology 135 (2000) 14-17.
Notification of Transmittal of the International Search Report and the Written Opinion of the International Searching Authority; PCT/US2011/047000; Korean Intellectual Property Office; Mailed Dec. 26, 2011; 8 pages.
Flow Control Systems, [online]; [retrieved on May 20, 2010]; retrieved from the Internet http://www.bakerhughes.com/products-and-services/completions-and-productions/well-completions/packers-and-flow-control/flow-control-systems.
Notification of Transmittal of the International Search Report and the Written Opinion of the International Searching Authority, or the Declaration mailed on Feb. 23, 2012 (Dated Feb. 22, 2012) for PCT/US2011/043036.
Optisleeve Sliding Sleeve, [online]; [retrieved on Jun. 25, 2010]; retrieved from the Internet weatherford.com/weatherford/groups/.../weatherfordcorp/WFT033159.pdf.
"Sliding Sleeve", Omega Completion Technology Ltd, Sep. 29, 2009, retrieved on: www.omega-completion.com.
Welch, William R. et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
International Search Report and Written Opinion of the International Searching Authority, or the Declaration for PCT/US2011/058105 mailed from the Korean Intellectual Property Office on May 1, 2012.
International Search Report and Written Opinion of the International Searching Authority for International Application No. PCT/US2011/058099 (filed on Oct. 27, 2011), mailed on May 11, 2012.

* cited by examiner

MULTI-COMPONENT DISAPPEARING TRIPPING BALL AND METHOD FOR MAKING THE SAME

CROSS REFERENCE TO RELATED APPLICATIONS

This application contains subject matter related to the subject matter of co-pending applications, which are assigned to the same assignee as this application, Baker Hughes Incorporated of Houston, Tex. and are all being filed on Dec. 8, 2009. The below listed applications are hereby incorporated by reference in their entirety:

U.S. patent application Ser. No. 12/633,682, entitled NANOMATRIX POWDER METAL COMPACT;

U.S. patent application Ser. No. 12/633,686, entitled COATED METALLIC POWDER AND METHOD OF MAKING THE SAME;

U.S. patent application Ser. No. 12/633,688, entitled METHOD OF MAKING A NANOMATRIX POWDER METAL COMPACT;

U.S. patent application Ser. No. 12/633,678 entitled ENGINEERED POWDER COMPACT COMPOSITE MATERIAL;

U.S. patent application Ser. No. 12/633,683 entitled TELESCOPIC UNIT WITH DISSOLVABLE BARRIER;

U.S. patent application Ser. No. 12/633,662 entitled DISSOLVING TOOL AND METHOD; and U.S. patent application Ser. No. 12/633,668 entitled DISSOLVING TOOL AND METHOD.

BACKGROUND

In the drilling and completion industry it is often desirable to utilize what is known to the art as tripping balls for a number of different operations requiring pressure up events. As is known to one of skill in the art, tripping balls are dropped at selected times to seat in a downhole ball seat and create a seal there. The seal that is created is often intended to be temporary. After the operation for which the tripping ball was dropped is completed, the ball is removed from the wellbore by reverse circulating the ball out of the well; drilling the ball out of the well; etc. In general, each of the prior art methods for removing a tripping ball from a wellbore requires action beyond what one of skill in the art would term a single trip and yet single trip is one of the things ubiquitously desired by well operators. Since tripping ball operations are plentiful, constructions and methods that would allow them to be used in a single trip operation would be well received by the art.

SUMMARY

Disclosed herein is a tripping ball. The ball includes, two or more relatively dissolution resistant parts of a ball and an adherent dissolvable material binding the two or more parts of the ball together.

Further disclosed herein is a method for making a tripping ball. The method includes, configuring two or more parts of a ball to collectively make up a portion of a tripping ball, and assembling the two or more parts with an adherent dissolvable material into a tripping ball.

BRIEF DESCRIPTION OF THE DRAWINGS

Referring now to the drawings wherein like elements are numbered alike in the several Figures.

DETAILED DESCRIPTION

Figure 1:
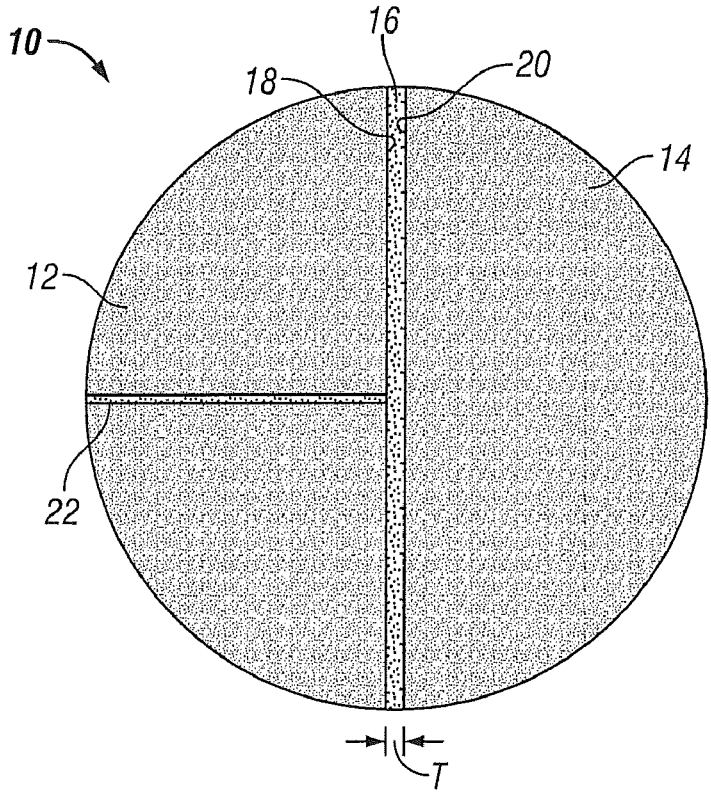
FIG. 1 is a schematic view of a tripping ball having two substantially hemispherical relatively dissolution resistant parts adhered together with an adherent dissolvable material.

Referring to FIG. 1, one embodiment of a tripping ball 10 is illustrated. This embodiment is configured with two hemispherical relatively dissolution resistant parts 12 and 14 and an adherent dissolvable material 16 adjoining the two parts 12 and 14. Since the three components introduced create together a sphere it should be appreciated that, in this embodiment, the adherent dissolvable material 16 is itself in the form of a very short cylinder since it is circular in geometry and does have a thickness T extending between interfaces 18 and 20 of the hemispheres 12 and 14, respectively. Notably, thickness T may be of whatever dimension is appropriate for a particular application. One should appreciate that dissolution of the adherent dissolvable material based upon contact with fluids either inherent in the wellbore or placed there for purposes of dissolution can occur only from the perimetrical edge of the dissolvable material unless that material itself is permeable or if one or more fluid holes 22 are provided. In the case of FIG. 1, a hole 22 is illustrated. This is an optional inclusion in the embodiment and more such holes are contemplated. Depending upon number, cross sectional dimensions and length of the holes 22, that the material 16 is selectively holed. Different effects on the adherent dissolvable material 16 are achieved, with greater effect being achieved with configurations facilitating greater fluid contact with the material 16. In some embodiments one or more holes may be configured in part to pass through one or more of the parts of the ball.

Figure 2:
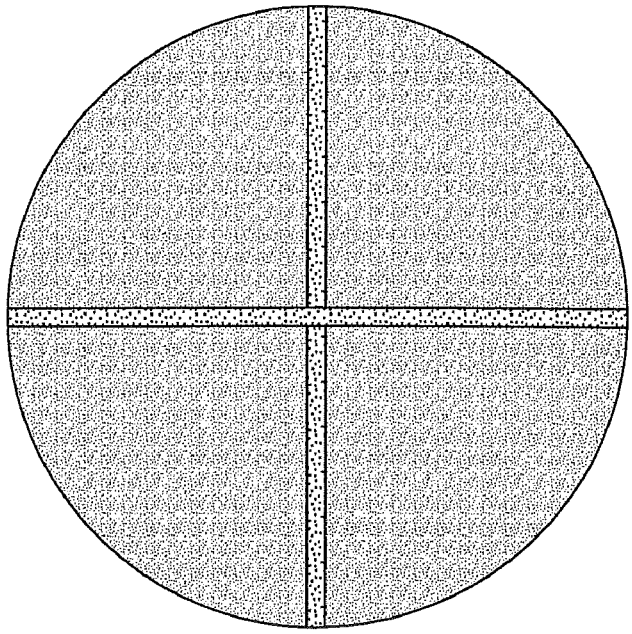
FIG. 2 is a schematic view of a tripping ball having four substantial quatershperes of relatively dissolution resistant parts adhered together with an adherent dissolvable material.

Returning to a more general discussion of the invention and the embodiment of FIG. 1, the concept being disclosed includes the provision of two or more parts 12 and 14 of a tripping ball 10 that are constructed of a relatively dissolution resistant material that are then adhered together by an adherent dissolvable material 16 to form a complete ball. Each of the two or more parts (e.g. 12 and 14) are themselves smaller than a ball seat (not shown) such that upon dissolution of the adherent dissolvable material 16, the two or more parts will move out of engagement with the ball seat. By "move out of engagement" it is intended that the reader understand that the ball can pass through the seat or a number of seats in either direction after dissolution of the adherent dissolvable material. Passage through a ball seat to a more downhole position is common but it is not uncommon for an operator to want to remove substantially all debris from the well by reverse circulation and it is intended that the parts be able to move back through the seats in the other direction (uphole direction) as well as the original movement in the downhole direction after a pressure up operation and dissolution of the adherent dissolvable material 16. In some embodiments, each of the parts of the ball 10 (two or more) will be some subset of a sphere. In one embodiment as noted they are substantially hemispherical while in other embodiments they may be quarter-spherical (FIG. 2) with consequently differing geometrical configurations of the adherent dissolvable material. It should be appreciated that whether or not the components are exactly hemi, quarter, etc. spherical depends upon whether or not the ultimate ball is to be spherical and the thickness of the adherent dissolvable material 16 desired for a particular application.

The material 16 will be disposed between all of the parts to keep them in position for the duration of the life of the adherent dissolvable material 16. Subsequent to that life ending through dissolution, the parts will fractionate and move through the seat upon which they were engaged for the previous pressure operation. The parts in one embodiment have a portion thereof that is coextensive with an exterior surface of the sphere and therefore have at least one surface that is part spherical while in another embodiment the parts are covered in the adherent dissolvable material 16 and need not have a part spherical surface. The parts are constructed of materials having sufficient strength (in some embodiments about 30-80 ksi (thousand pounds per square inch)) to support the load of a pressure up operation for, for example, a fracing job. The material may be such as phenolic, metal, ceramic, rubber, etc.

It should be appreciated that the greater the number of parts of the ball 10, the easier it will be to move the parts through the ball seat post dissolution of the adherent dissolvable material 16. Further it is to be appreciated that in each embodiment the optional holes 22 may be employed to tailor the time of dissolution of the material 16. It will further be appreciated that the actual rate of dissolution is a different matter and is selected during preparation of the adherent dissolvable material 16. The material will dissolve at a fixed rate but the actual time duration for disengagement of the parts of the ball will depend upon the surface area of the adherent dissolvable material 16 that is in contact with a dissolutant fluid. This surface area of dissolutant contact is directly affected by whether or not and the number of holes 22 employed in a particular iteration of ball 10. The greater the number of passageways and the larger the individual passageway cross sections the greater the surface area of the adherent dissolvable material 16 that is exposed to fluids downhole. Further, as noted above, the adherent dissolvable material may itself be an open cellular matrix such that fluids may penetrate the same entirely such as in the case of a sponge in water. This will provide a very large contact surface area for whatever the dissolutant fluid is (water, oil, other natural downhole fluids or fluids introduced to the downhole environment either for this specific purpose or for other purposes.

Materials employable for the adherent dissolvable material include but are not limited to Magnesium, polymeric adhesives such as structural methacrylate adhesive, high strength dissolvable Material (discussed in detail later in this specification), etc. These materials may be configured as solder (temperature based fluidity), glue, in solid state for and may be configured in other forms as desired. Solid state material is used for bonding processes using, temperature and pressure, brazing, welding (resistance or filler wire). Any of the configurations listed or indeed others are acceptable as long as they function to hold the two or more parts of the ball together for a period of time (dictated by the rate of dissolution and surface area presented to dissolutant fluid) sufficient to maintain the ball in an intact condition long enough to provide for whatever downhole operation for which it is intended to be used. In some applications the dissolution time will be set to about 4 minutes to about 10 minutes, but it will be understood that the time is easily adjustable based upon the parameters noted above.

Based upon the foregoing, it will be understood that two or more relatively dissolution resistant parts of a ball with an adherent dissolvable material adhering the two or more parts together for an adjustable period of time provides for great advantage in the downhole drilling and completion arts since it increases flexibility in the order in which downhole operations are carried out and reduces or eliminates ancillary operations to reopen ball seats for other operations.

In use, the ball as described above is dropped into a borehole and seated on a seat either by gravity, pumping or both. Once seated, the ball may be pressured against for a desired operation. The ball is configured to hold the anticipated pressure without structural degradation but then to lose structural integrity upon the dissolution of the adherent dissolvable material 16. Thereafter, the ball will break into a number of parts (two or more) and pass through the seat thereby opening the same and leaving the borehole ready for another operation.

As introduced above, further materials that may be utilized with the ball as described herein are lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 3:
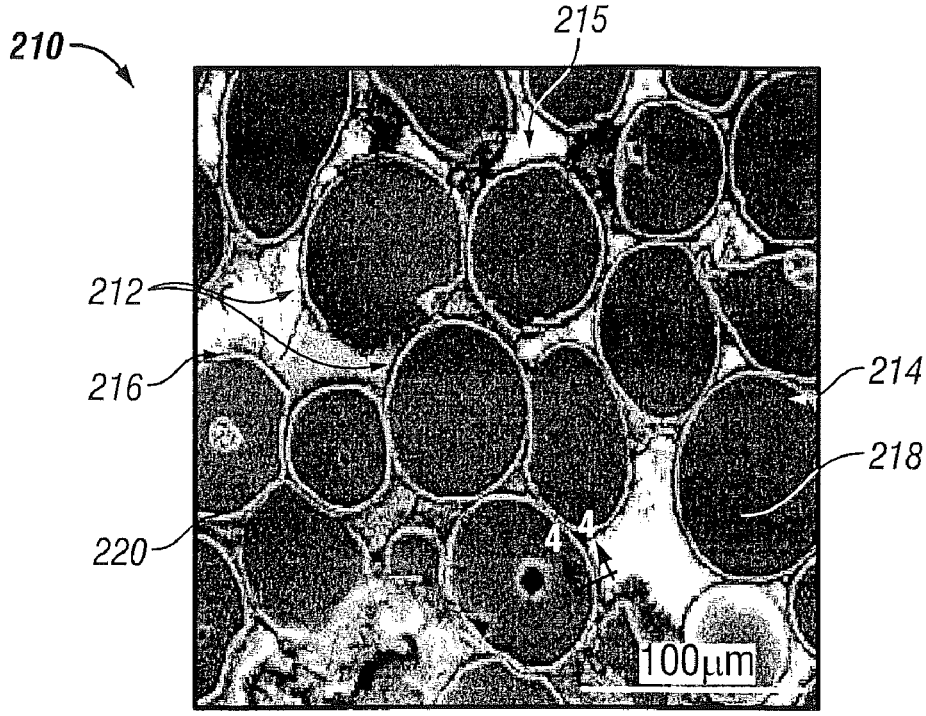
FIG. 3 is a photomicrograph of a powder 210 as disclosed herein that has been embedded in a potting material and sectioned.

Referring to FIG. 3, a metallic powder 210 includes a plurality of metallic, coated powder particles 212. Powder particles 212 may be formed to provide a powder 210, including free-flowing powder, that may be poured or otherwise disposed in all manner of forms or molds (not shown) having all manner of shapes and sizes and that may be used to fashion powder compacts 400 (FIGS. 6 and 7), as described herein, that may be used as, or for use in manufacturing, various articles of manufacture, including various wellbore tools and components.

Each of the metallic, coated powder particles 212 of powder 210 includes a particle core 214 and a metallic coating layer 216 disposed on the particle core 214. The particle core 214 includes a core material 218. The core material 218 may include any suitable material for forming the particle core 214 that provides powder particle 212 that can be sintered to form a lightweight, high-strength powder compact 400 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 218 may also include other metals that are less electrochemically active than Zn or non-metallic materials, or a combination thereof. Suitable non-metallic materials include ceramics, composites, glasses or carbon, or a combination thereof. Core material 218 may be selected to provide a high dissolution rate in a predetermined wellbore fluid, but may also be selected to provide a relatively low dissolution rate, including zero dissolution, where dissolution of the nanomatrix material causes the particle core 214 to be rapidly undermined and liberated from the particle compact at the interface with the wellbore fluid, such that the effective rate of dissolution of particle compacts made using particle cores 214 of these core materials 218 is high, even though core material 218 itself may have a low dissolution rate, including core materials 220 that may be substantially insoluble in the wellbore fluid.

With regard to the electrochemically active metals as core materials 218, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 18 may also include other constituents, including various alloying additions, to alter one or more properties of the particle cores 214, such as by improving the strength, lowering the density or altering the dissolution characteristics of the core material 218.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 214 and core material 218, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 214 and core material 218 have a melting temperature ($T_P$). As used herein, $T_P$ includes the lowest temperature at which incipient melting or liquation or other forms of partial melting occur within core material 218, regardless of whether core material 218 comprises a pure metal, an alloy with multiple phases having different melting temperatures or a composite of materials having different melting temperatures.

Particle cores 214 may have any suitable particle size or range of particle sizes or distribution of particle sizes. For example, the particle cores 214 may be selected to provide an average particle size that is represented by a normal or Gaussian type unimodal distribution around an average or mean, as illustrated generally in FIG. 3. In another example, particle cores 214 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 215 of the particles 212 of powder 210. In an exemplary embodiment, the particle cores 214 may have a unimodal distribution and an average particle diameter of about 5 μm to about 300 μm, more particularly about 80 μm to about 120 μm, and even more particularly about 100 μm.

Particle cores 214 may have any suitable particle shape, including any regular or irregular geometric shape, or combination thereof. In an exemplary embodiment, particle cores 214 are substantially spheroidal electrochemically active metal particles. In another exemplary embodiment, particle cores 214 are substantially irregularly shaped ceramic particles. In yet another exemplary embodiment, particle cores 214 are carbon or other nanotube structures or hollow glass microspheres.

Figure 4:
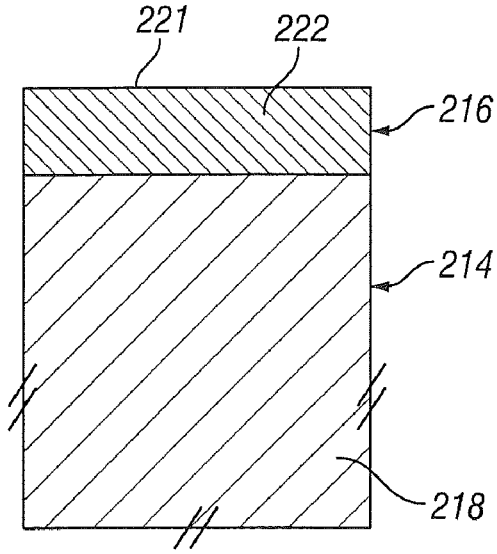
FIG. 4 is a schematic illustration of an exemplary embodiment of a powder particle 12 as it would appear in an exemplary section view represented by section 4-4 of FIG. 3.

Each of the metallic, coated powder particles 212 of powder 210 also includes a metallic coating layer 216 that is disposed on particle core 214. Metallic coating layer 216 includes a metallic coating material 220. Metallic coating material 220 gives the powder particles 212 and powder 210 its metallic nature. Metallic coating layer 216 is a nanoscale coating layer. In an exemplary embodiment, metallic coating layer 216 may have a thickness of about 25 nm to about 2500 nm. The thickness of metallic coating layer 216 may vary over the surface of particle core 214, but will preferably have a substantially uniform thickness over the surface of particle core 214. Metallic coating layer 216 may include a single layer, as illustrated in FIG. 4, or a plurality of layers as a multilayer coating structure. In a single layer coating, or in each of the layers of a multilayer coating, the metallic coating layer 216 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 216, each of the respective layers, or combinations of them, may be used to provide a predetermined property to the powder particle 212 or a sintered powder compact formed therefrom. For example, the predetermined property may include the bond strength of the metallurgical bond between the particle core 214 and the coating material 220; the interdiffusion characteristics between the particle core 214 and metallic coating layer 216, including any interdiffusion between the layers of a multilayer coating layer 216; the interdiffusion characteristics between the various layers of a multilayer coating layer 216; the interdiffusion characteristics between the metallic coating layer 216 of one powder particle and that of an adjacent powder particle 212; the bond strength of the metallurgical bond between the metallic coating layers of adjacent sintered powder particles 212, including the outermost layers of multilayer coating layers; and the electrochemical activity of the coating layer 216.

Metallic coating layer 216 and coating material 220 have a melting temperature ($T_C$). As used herein, $T_C$ includes the lowest temperature at which incipient melting or liquation or other forms of partial melting occur within coating material 220, regardless of whether coating material 220 comprises a pure metal, an alloy with multiple phases each having different melting temperatures or a composite, including a composite comprising a plurality of coating material layers having different melting temperatures.

Metallic coating material 220 may include any suitable metallic coating material 220 that provides a sinterable outer surface 221 that is configured to be sintered to an adjacent powder particle 212 that also has a metallic coating layer 216 and sinterable outer surface 221. In powders 210 that also include second or additional (coated or uncoated) particles 232, as described herein, the sinterable outer surface 221 of metallic coating layer 216 is also configured to be sintered to a sinterable outer surface 221 of second particles 232. In an exemplary embodiment, the powder particles 212 are sinterable at a predetermined sintering temperature ($T_S$) that is a function of the core material 218 and coating material 220, such that sintering of powder compact 400 is accomplished entirely in the solid state and where $T_S$ is less than $T_P$ and $T_C$. Sintering in the solid state limits particle core 214/metallic coating layer 216 interactions to solid state diffusion processes and metallurgical transport phenomena and limits growth of and provides control over the resultant interface between them. In contrast, for example, the introduction of liquid phase sintering would provide for rapid interdiffusion of the particle core 214/metallic coating layer 216 materials and make it difficult to limit the growth of and provide control over the resultant interface between them, and thus interfere with the formation of the desirable microstructure of particle compact 400 as described herein.

In an exemplary embodiment, core material 218 will be selected to provide a core chemical composition and the coating material 220 will be selected to provide a coating chemical composition and these chemical compositions will also be selected to differ from one another. In another exemplary embodiment, the core material 218 will be selected to provide a core chemical composition and the coating material 220 will be selected to provide a coating chemical composition and these chemical compositions will also be selected to differ from one another at their interface. Differences in the chemical compositions of coating material 220 and core material 218 may be selected to provide different dissolution rates and selectable and controllable dissolution of powder compacts 400 that incorporate them making them selectably and controllably dissolvable. This includes dissolution rates that differ in response to a changed condition in the wellbore, including an indirect or direct change in a wellbore fluid. In an exemplary embodiment, a powder compact 400 formed from powder 210 having chemical compositions of core material 218 and coating material 220 that make compact 400 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 5:
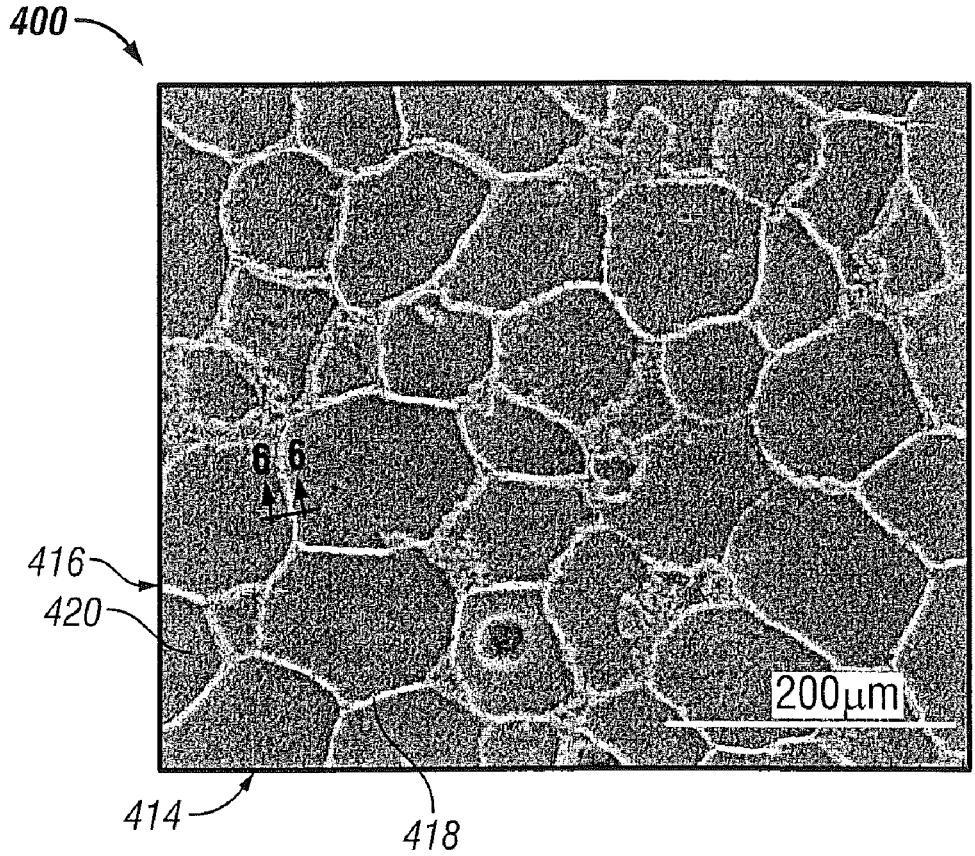
FIG. 5 is a photomicrograph of an exemplary embodiment of a powder compact as disclosed herein.

As illustrated in FIGS. 3 and 5, particle core 214 and core material 218 and metallic coating layer 216 and coating material 220 may be selected to provide powder particles 212 and a powder 210 that is configured for compaction and sintering to provide a powder compact 400 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 400 includes a substantially-continuous, cellular nanomatrix 416 of a nanomatrix material 420 having a plurality of dispersed particles 414 dispersed throughout the cellular nanomatrix 416. The substantially-continuous cellular nanomatrix 416 and nanomatrix material 420 formed of sintered metallic coating layers 216 is formed by the compaction and sintering of the plurality of metallic coating layers 216 of the plurality of powder particles 212. The chemical composition of nanomatrix material 420 may be different than that of coating material 220 due to diffusion effects associated with the sintering as described herein. Powder metal compact 400 also includes a plurality of dispersed particles 414 that comprise particle core material 418. Dispersed particle cores 414 and core material 418 correspond to and are formed from the plurality of particle cores 214 and core material 218 of the plurality of powder particles 212 as the metallic coating layers 216 are sintered together to form nanomatrix 416. The chemical composition of core material 418 may be different than that of core material 218 due to diffusion effects associated with sintering as described herein.

As used herein, the use of the term substantially-continuous cellular nanomatrix 416 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 420 within powder compact 400. As used herein, "substantially-continuous" describes the extension of the nanomatrix material throughout powder compact 400 such that it extends between and envelopes substantially all of the dispersed particles 414. Substantially-continuous is used to indicate that complete continuity and regular order of the nanomatrix around each dispersed particle 414 is not required. For example, defects in the coating layer 216 over particle core 214 on some powder particles 212 may cause bridging of the particle cores 214 during sintering of the powder compact 400, thereby causing localized discontinuities to result within the cellular nanomatrix 416, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 420 that encompass and also interconnect the dispersed particles 414. As used herein, "nanomatrix" is used to describe the size or scale of the matrix, particularly the thickness of the matrix between adjacent dispersed particles 414. The metallic coating layers that are sintered together to form the nanomatrix are themselves nanoscale thickness coating layers. Since the nanomatrix at most locations, other than the intersection of more than two dispersed particles 414, generally comprises the interdiffusion and bonding of two coating layers 216 from adjacent powder particles 212 having nanoscale thicknesses, the matrix formed also has a nanoscale thickness (e.g., approximately two times the coating layer thickness as described herein) and is thus described as a nanomatrix. Further, the use of the term dispersed particles 414 does not connote the minor constituent of powder compact 400, but rather refers to the majority constituent or constituents, whether by weight or by volume. The use of the term dispersed particle is intended to convey the discontinuous and discrete distribution of particle core material 418 within powder compact 400.

Powder compact 400 may have any desired shape or size, including that of a cylindrical billet or bar that may be machined or otherwise used to form useful articles of manufacture, including various wellbore tools and components. The sintering and pressing processes used to form powder compact 400 and deform the powder particles 212, including particle cores 214 and coating layers 216, to provide the full density and desired macroscopic shape and size of powder compact 400 as well as its microstructure. The microstructure of powder compact 400 includes an equiaxed configuration of dispersed particles 414 that are dispersed throughout and embedded within the substantially-continuous, cellular nanomatrix 416 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 416 of sintered metallic coating layers 216 may be produced using constituents where thermodynamic phase equilibrium conditions would not produce an equiaxed structure. The equiaxed morphology of the dispersed particles 414 and cellular network 416 of particle layers results from sintering and deformation of the powder particles 212 as they are compacted and interdiffuse and deform to fill the interparticle spaces 215 (FIG. 3). The sintering temperatures and pressures may be selected to ensure that the density of powder compact 400 achieves substantially full theoretical density.

Figure 6:
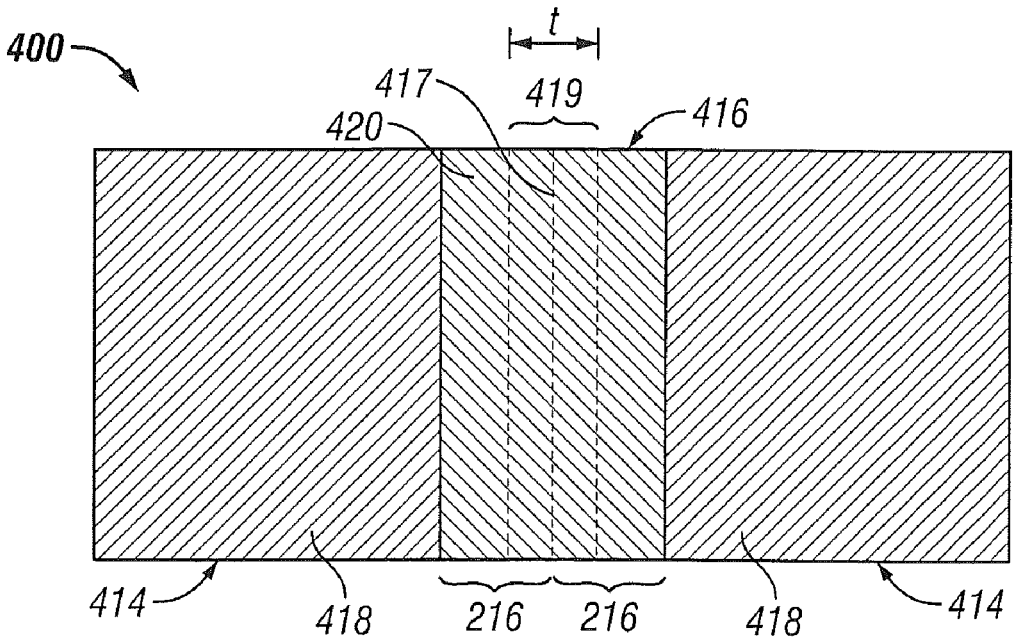
FIG. 6 is a schematic of illustration of an exemplary embodiment of a powder compact made using a powder having single-layer powder particles as it would appear taken along section 6-6 in FIG. 5.

In an exemplary embodiment as illustrated in FIGS. 3 and 5, dispersed particles 414 are formed from particle cores 214 dispersed in the cellular nanomatrix 416 of sintered metallic coating layers 216, and the nanomatrix 416 includes a solid-state metallurgical bond 417 or bond layer 419, as illustrated schematically in FIG. 6, extending between the dispersed particles 414 throughout the cellular nanomatrix 416 that is formed at a sintering temperature ($T_S$), where $T_S$ is less than $T_C$ and $T_P$. As indicated, solid-state metallurgical bond 417 is formed in the solid state by solid-state interdiffusion between the coating layers 216 of adjacent powder particles 212 that are compressed into touching contact during the compaction and sintering processes used to form powder compact 400, as described herein. As such, sintered coating layers 216 of cellular nanomatrix 416 include a solid-state bond layer 419 that has a thickness (t) defined by the extent of the interdiffusion of the coating materials 220 of the coating layers 216, which will in turn be defined by the nature of the coating layers 216, including whether they are single or multilayer coating layers, whether they have been selected to promote or limit such interdiffusion, and other factors, as described herein, as well as the sintering and compaction conditions, including the sintering time, temperature and pressure used to form powder compact 400.

As nanomatrix 416 is formed, including bond 417 and bond layer 419, the chemical composition or phase distribution, or both, of metallic coating layers 216 may change. Nanomatrix 416 also has a melting temperature ($T_M$). As used herein, $T_M$ includes the lowest temperature at which incipient melting or liquation or other forms of partial melting will occur within nanomatrix 416, regardless of whether nanomatrix material 420 comprises a pure metal, an alloy with multiple phases each having different melting temperatures or a composite, including a composite comprising a plurality of layers of various coating materials having different melting temperatures, or a combination thereof, or otherwise. As dispersed particles 414 and particle core materials 418 are formed in conjunction with nanomatrix 416, diffusion of constituents of metallic coating layers 216 into the particle cores 214 is also possible, which may result in changes in the chemical composition or phase distribution, or both, of particle cores 214. As a result, dispersed particles 414 and particle core materials 418 may have a melting temperature ($T_{DP}$) that is different than $T_P$. As used herein, $T_{DP}$ includes the lowest temperature at which incipient melting or liquation or other forms of partial melting will occur within dispersed particles 214, regardless of whether particle core material 218 comprise a pure metal, an alloy with multiple phases each having different melting temperatures or a composite, or otherwise. Powder compact 400 is formed at a sintering temperature ($T_S$), where $T_S$ is less than $T_C$, $T_P$, $T_M$ and $T_{DP}$.

Dispersed particles 414 may comprise any of the materials described herein for particle cores 214, even though the chemical composition of dispersed particles 414 may be different due to diffusion effects as described herein. In an exemplary embodiment, dispersed particles 414 are formed from particle cores 214 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 214. Of these materials, those having dispersed particles 414 comprising Mg and the nanomatrix 416 formed from the metallic coating materials 216 described herein are particularly useful. Dispersed particles 414 and particle core material 418 of Mg, Al, Zn or Mn, or a combination thereof, may also include a rare earth element, or a combination of rare earth elements as disclosed herein in conjunction with particle cores 214.

In another exemplary embodiment, dispersed particles 414 are formed from particle cores 214 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 414 of powder compact 400 may have any suitable particle size, including the average particle sizes described herein for particle cores 214.

Dispersed particles 414 may have any suitable shape depending on the shape selected for particle cores 214 and powder particles 212, as well as the method used to sinter and compact powder 210. In an exemplary embodiment, powder particles 212 may be spheroidal or substantially spheroidal and dispersed particles 414 may include an equiaxed particle configuration as described herein.

The nature of the dispersion of dispersed particles 414 may be affected by the selection of the powder 210 or powders 210 used to make particle compact 400. In one exemplary embodiment, a powder 210 having a unimodal distribution of powder particle 212 sizes may be selected to form powder compact 2200 and will produce a substantially homogeneous unimodal dispersion of particle sizes of dispersed particles 414 within cellular nanomatrix 416, as illustrated generally in FIG. 5. In another exemplary embodiment, a plurality of powders 210 having a plurality of powder particles with particle cores 214 that have the same core materials 218 and different core sizes and the same coating material 220 may be selected and uniformly mixed as described herein to provide a powder 210 having a homogenous, multimodal distribution of powder particle 212 sizes, and may be used to form powder compact 400 having a homogeneous, multimodal dispersion of particle sizes of dispersed particles 414 within cellular nanomatrix 416. Similarly, in yet another exemplary embodiment, a plurality of powders 210 having a plurality of particle cores 214 that may have the same core materials 218 and different core sizes and the same coating material 220 may be selected and distributed in a non-uniform manner to provide a non-homogenous, multimodal distribution of powder particle sizes, and may be used to form powder compact 400 having a non-homogeneous, multimodal dispersion of particle sizes of dispersed particles 414 within cellular nanomatrix 416. The selection of the distribution of particle core size may be used to determine, for example, the particle size and interparticle spacing of the dispersed particles 414 within the cellular nanomatrix 416 of powder compacts 400 made from powder 210.

Nanomatrix 416 is a substantially-continuous, cellular network of metallic coating layers 216 that are sintered to one another. The thickness of nanomatrix 416 will depend on the nature of the powder 210 or powders 210 used to form powder compact 400, as well as the incorporation of any second powder 230, particularly the thicknesses of the coating layers associated with these particles. In an exemplary embodiment, the thickness of nanomatrix 416 is substantially uniform throughout the microstructure of powder compact 400 and comprises about two times the thickness of the coating layers 216 of powder particles 212. In another exemplary embodiment, the cellular network 416 has a substantially uniform average thickness between dispersed particles 414 of about 50 nm to about 5000 nm.

Nanomatrix 416 is formed by sintering metallic coating layers 216 of adjacent particles to one another by interdiffusion and creation of bond layer 419 as described herein. Metallic coating layers 216 may be single layer or multilayer structures, and they may be selected to promote or inhibit diffusion, or both, within the layer or between the layers of metallic coating layer 216, or between the metallic coating layer 216 and particle core 214, or between the metallic coating layer 216 and the metallic coating layer 216 of an adjacent powder particle, the extent of interdiffusion of metallic coating layers 216 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 416 and nanomatrix material 420 may be simply understood to be a combination of the constituents of coating layers 216 that may also include one or more constituents of dispersed particles 414, depending on the extent of interdiffusion, if any, that occurs between the dispersed particles 414 and the nanomatrix 416. Similarly, the chemical composition of dispersed particles 414 and particle core material 418 may be simply understood to be a combination of the constituents of particle core 214 that may also include one or more constituents of nanomatrix 416 and nanomatrix material 420, depending on the extent of interdiffusion, if any, that occurs between the dispersed particles 414 and the nanomatrix 416.

In an exemplary embodiment, the nanomatrix material 420 has a chemical composition and the particle core material 418 has a chemical composition that is different from that of nanomatrix material 420, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 400, including a property change in a wellbore fluid that is in contact with the powder compact 400, as described herein. Nanomatrix 416 may be formed from powder particles 212 having single layer and multilayer coating layers 216. This design flexibility provides a large number of material combinations, particularly in the case of multilayer coating layers 216, that can be utilized to tailor the cellular nanomatrix 416 and composition of nanomatrix material 420 by controlling the interaction of the coating layer constituents, both within a given layer, as well as between a coating layer 216 and the particle core 214 with which it is associated or a coating layer 216 of an adjacent powder particle 212. Several exemplary embodiments that demonstrate this flexibility are provided below.

As illustrated in FIG. 6, in an exemplary embodiment, powder compact 400 is formed from powder particles 212 where the coating layer 216 comprises a single layer, and the resulting nanomatrix 416 between adjacent ones of the plurality of dispersed particles 414 comprises the single metallic coating layer 216 of one powder particle 212, a bond layer 419 and the single coating layer 216 of another one of the adjacent powder particles 212. The thickness (t) of bond layer 419 is determined by the extent of the interdiffusion between the single metallic coating layers 216, and may encompass the entire thickness of nanomatrix 416 or only a portion thereof. In one exemplary embodiment of powder compact 400 formed using a single layer powder 210, powder compact 400 may include dispersed particles 414 comprising Mg, Al, Zn or Mn, or a combination thereof, as described herein, and nanomatrix 416 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 420 of cellular nanomatrix 416, including bond layer 419, has a chemical composition and the core material 418 of dispersed particles 414 has a chemical composition that is different than the chemical composition of nanomatrix material 416. The difference in the chemical composition of the nanomatrix material 420 and the core material 418 may be used to provide selectable and controllable dissolution in response to a change in a property of a wellbore, including a wellbore fluid, as described herein. In a further exemplary embodiment of a powder compact 400 formed from a powder 210 having a single coating layer configuration, dispersed particles 414 include Mg, Al, Zn or Mn, or a combination thereof, and the cellular nanomatrix 416 includes Al or Ni, or a combination thereof.

Figure 7:
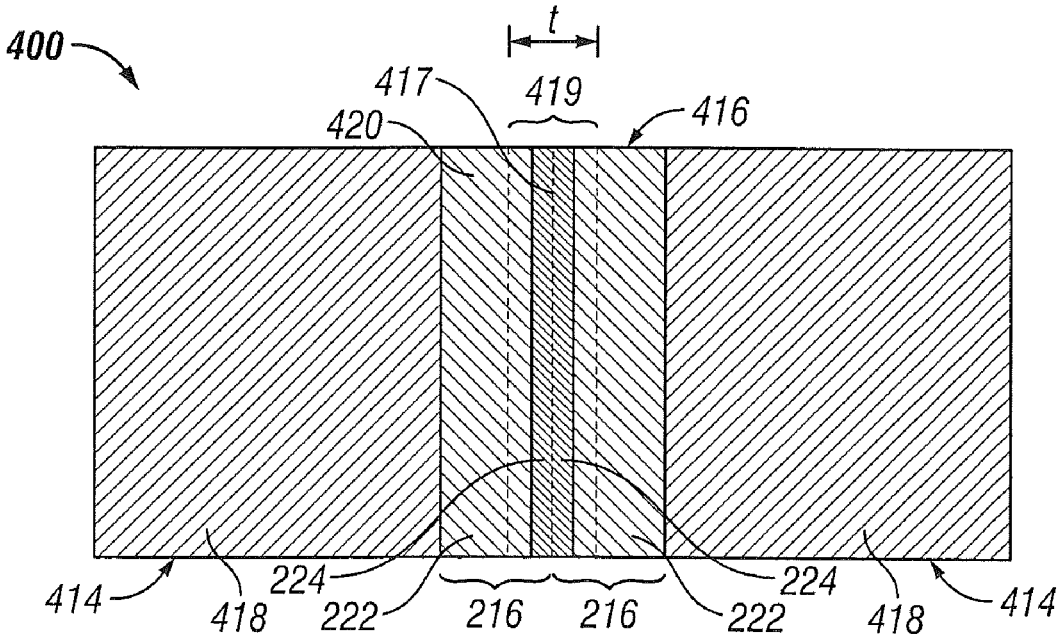
FIG. 7 is a schematic of illustration of another exemplary embodiment of a powder compact made using a powder having multilayer powder particles as it would appear taken along section 6-6 in FIG. 5.

As illustrated in FIG. 7, in another exemplary embodiment, powder compact 400 is formed from powder particles 212 where the coating layer 216 comprises a multilayer coating layer 216 having a plurality of coating layers, and the resulting nanomatrix 416 between adjacent ones of the plurality of dispersed particles 414 comprises the plurality of layers (t) comprising the coating layer 216 of one particle 212, a bond layer 419, and the plurality of layers comprising the coating layer 216 of another one of powder particles 212. In FIG. 7, this is illustrated with a two-layer metallic coating layer 216, but it will be understood that the plurality of layers of multilayer metallic coating layer 216 may include any desired number of layers. The thickness (t) of the bond layer 419 is again determined by the extent of the interdiffusion between the plurality of layers of the respective coating layers 216, and may encompass the entire thickness of nanomatrix 416 or only a portion thereof. In this embodiment, the plurality of layers comprising each coating layer 216 may be used to control interdiffusion and formation of bond layer 419 and thickness (t).

Sintered and forged powder compacts 400 that include dispersed particles 414 comprising Mg and nanomatrix 416 comprising various nanomatrix materials as described herein have demonstrated an excellent combination of mechanical strength and low density that exemplify the lightweight, high-strength materials disclosed herein. Examples of powder compacts 400 that have pure Mg dispersed particles 414 and various nanomatrices 416 formed from powders 210 having pure Mg particle cores 214 and various single and multilayer metallic coating layers 216 that include Al, Ni, W or $Al_2O_3$, or a combination thereof. These powders compacts 400 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 200 may also be configured to provide substantially enhanced properties as compared to powder compacts formed from pure Mg particles that do not include the nanoscale coatings described herein. Powder compacts 400 that include dispersed particles 414 comprising Mg and nanomatrix 416 comprising various nanomatrix materials 420 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 400 can be further improved by optimizing powder 210, particularly the weight percentage of the nanoscale metallic coating layers 16 that are used to form cellular nanomatrix 416. Strength of the nanomatrix powder metal compact 400 can be further improved by optimizing powder 210, particularly the weight percentage of the nanoscale metallic coating layers 216 that are used to form cellular nanomatrix 416. For example, varying the weight percentage (wt. %), i.e., thickness, of an alumina coating within a cellular nanomatrix 416 formed from coated powder particles 212 that include a multilayer ($Al/Al_2O_3/Al$) metallic coating layer 216 on pure Mg particle cores 214 provides an increase of 21% as compared to that of 0 wt % alumina.

Powder compacts 400 comprising dispersed particles 414 that include Mg and nanomatrix 416 that includes various nanomatrix materials as described herein have also demonstrated a room temperature sheer strength of at least about 20 ksi. This is in contrast with powder compacts formed from pure Mg powders which have room temperature sheer strengths of about 8 ksi.

Powder compacts 400 of the types disclosed herein are able to achieve an actual density that is substantially equal to the predetermined theoretical density of a compact material based on the composition of powder 210, including relative amounts of constituents of particle cores 214 and metallic coating layer 216, and are also described herein as being fully-dense powder compacts. Powder compacts 400 comprising dispersed particles that include Mg and nanomatrix 416 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Figure 8:
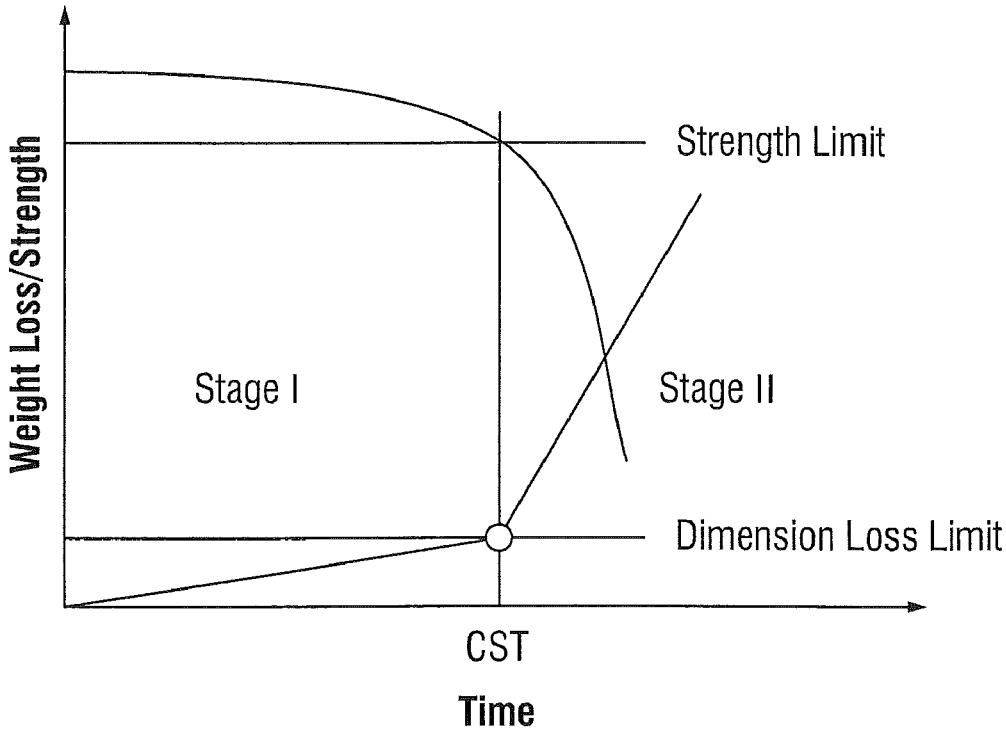
FIG. 8 is a schematic illustration of a change in a property of a powder compact as disclosed herein as a function of time and a change in condition of the powder compact environment.

Powder compacts 400 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 400 comprising dispersed particles 414 that include Mg and cellular nanomatrix 416 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 216. An example of a changed condition comprising a change in chemical composition includes a change in a chloride ion concentration or pH value, or both, of the wellbore fluid. For example, powder compacts 400 comprising dispersed particles 414 that include Mg and nanomatrix 416 that includes various nanoscale coatings described herein demonstrate corrosion rates in 15% HCl that range from about 4750 mg/cm$^2$/hr to about 7432 mg/cm$^2$/hr. Thus, selectable and controllable dissolvability in response to a changed condition in the wellbore, namely the change in the wellbore fluid chemical composition from KCl to HCl, may be used to achieve a characteristic response as illustrated graphically in FIG. 8, which illustrates that at a selected predetermined critical service time (CST) a changed condition may be imposed upon powder compact 400 as it is applied in a given application, such as a wellbore environment, that causes a controllable change in a property of powder compact 400 in response to a changed condition in the environment in which it is applied. For example, at a predetermined CST changing a wellbore fluid that is in contact with powder contact 400 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 400 as disclosed herein is no longer needed in service in the wellbore (e.g., the CST) the condition in the wellbore (e.g., the chloride ion concentration of the wellbore fluid) may be changed to cause the rapid dissolution of powder compact 400 and its removal from the wellbore. In the example described above, powder compact 400 is selectably dissolvable at a rate that ranges from about 0 to about 7000 mg/cm$^2$/hr. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 400 described herein and includes a cellular nanomatrix 416 of nanomatrix material 420, a plurality of dispersed particles 414 including particle core material 418 that is dispersed within the matrix. Nanomatrix 416 is characterized by a solid-state bond layer 419, which extends throughout the nanomatrix. The time in contact with the fluid described above may include the CST as described above. The CST may include a predetermined time that is desired or required to dissolve a predetermined portion of the powder compact 400 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 8.

Without being limited by theory, powder compacts 400 are formed from coated powder particles 212 that include a particle core 214 and associated core material 218 as well as a metallic coating layer 216 and an associated metallic coating material 220 to form a substantially-continuous, three-dimensional, cellular nanomatrix 216 that includes a nanomatrix material 420 formed by sintering and the associated diffusion bonding of the respective coating layers 216 that includes a plurality of dispersed particles 414 of the particle core materials 418. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 400, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 416, which may be selected to provide a strengthening phase material, with dispersed particles 414, which may be selected to provide equiaxed dispersed particles 414, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 400 made using uncoated pure Mg powder and subjected to a shear stress sufficient to induce failure demonstrated intergranular fracture. In contrast, a powder compact 400 made using powder particles 212 having pure Mg powder particle cores 214 to form dispersed particles 414 and metallic coating layers 216 that includes Al to form nanomatrix 416 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A tripping ball comprising:

two or more dissolution resistant parts of a ball; and an adherent dissolvable material binding the two or more parts of the ball together, the adherent material operatively arranged to dissolve for enabling the two or more dissolution resistant parts of the ball to separate from each other.

2. A tripping ball as claimed in claim 1 wherein the parts of the ball are hemispheres.

3. A tripping ball as claimed in claim 1 wherein the parts of the ball are quarterspheres.

4. A tripping ball as claimed in claim 1 wherein the parts of the ball include at least one surface that is a portion of a sphere.

5. A tripping ball as claimed in claim 1 wherein the parts of the ball comprise metallic material.

6. A tripping ball as claimed in claim 1 wherein the parts of the ball comprise polymeric material.

7. A tripping ball as claimed in claim 1 wherein the adherent dissolvable material comprises magnesium.

8. A tripping ball as claimed in claim 1 wherein the adherent dissolvable material includes one or more holes therein.

9. A tripping ball as claimed in claim 8 wherein the adherent dissolvable material is drilled to produce the one or more holes.

10. A tripping ball as claimed in claim 8 wherein the holes are disposed at least in part in the parts of the ball.

11. A tripping ball as claimed in claim 8 wherein the holes are configured to provide a selective flow rate of wellbore fluids into the tripping ball.

12. A tripping ball as claimed in claim 1 wherein one or more of the parts of the ball are selectively holed.

13. A tripping ball as claimed in claim 1 wherein the adherent dissolvable material is formed in an open cellular structure.

14. A tripping ball as claimed in claim 1 wherein the adherent dissolvable material is formed to provide fluid pathways therein.

15. A tripping ball as claimed in claim 1 wherein the adherent dissolvable material is responsive to wellbore fluids.

16. A tripping ball as claimed in claim 1 wherein the adherent dissolvable material is configurable for a selected dissolution time when exposed to downhole conditions.

17. A tripping ball as claimed in claim 1 wherein the adherent dissolvable material comprises:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid state bond layer extending throughout the cellular nanomatrix between the dispersed particles.

18. A tripping ball as claimed in claim 17, wherein the nanomatrix material has a melting temperature ($T_M$), the particle core material has a melting temperature ($T_{DP}$); wherein the adherent dissolvable material is sinterable in a solid-state at a sintering temperature ($T_S$), and $T_S$ is less than $T_M$ and $T_{DP}$.

19. A tripping ball as claimed in claim 17, wherein the dispersed particles comprise Mg—Zn, Mg—Zn, Mg—Al, Mg—Mn, or Mg—Zn—Y.

20. A tripping ball as claimed in claim 17, wherein the dispersed particles comprise an Mg—Al—X alloy, wherein X comprises Zn, Mn, Si, Ca or Y, or a combination thereof.

21. A tripping ball as claimed in claim 17, wherein the dispersed particles further comprise a rare earth element.

22. A tripping ball as claimed in claim 17, wherein the dispersed particles have an average particle size of about 5 μm to about 300 μm.

23. A tripping ball as claimed in claim 17, wherein the dispersed particles have an equiaxed particle shape.

24. A tripping ball as claimed in claim 17, further comprising a plurality of dispersed second particles, wherein the dispersed second particles are also dispersed within the cellular nanomatrix and with respect to the dispersed particles.

25. A tripping ball as claimed in claim 24, wherein the dispersed second particles comprise Fe, Ni, Co or Cu, or oxides, nitrides or carbides thereof, or a combination of any of the aforementioned materials.

26. A tripping ball as claimed in claim 17, wherein the nanomatrix material comprises Al, Zn, Mn, Mg, Mo, W, Cu, Fe, Si, Ca, Co, Ta, Re or Ni, or an oxide, carbide or nitride thereof, or a combination of any of the aforementioned materials, and wherein the nanomatrix material has a chemical composition and the particle core material has a chemical composition that is different than the chemical composition of the nanomatrix material.

27. A tripping ball as claimed in claim 17, wherein the nanomatrix has an average thickness of about 50 nm to about 5000 nm.

28. A tripping ball as claimed in claim 17, wherein the adherent dissolvable material is formed from a sintered powder comprising a plurality of powder particles, each powder particle having a particle core that upon sintering comprises a dispersed particle and a single metallic coating layer disposed thereon, and wherein the nanomatrix between adjacent ones of the plurality of dispersed particles comprises the single metallic coating layer of one powder particle, the bond layer and the single metallic coating layer of another of the powder particles.

29. A tripping ball as claimed in claim 17, wherein the adherent dissolvable material is formed from a sintered powder comprising a plurality of powder particles, each powder particle having a particle core that upon sintering comprises a dispersed particle and a plurality of metallic coating layers disposed thereon, and wherein the nanomatrix between adjacent ones of the plurality of dispersed particles comprises the plurality of metallic coating layers of one powder particle, the bond layer and plurality of metallic coating layers of another of the powder particles, and wherein adjacent ones of the plurality of metallic coating layers have different chemical compositions.

30. A tripping ball as claimed in claim 17, wherein the dispersed particles comprise Mg and the adherent dissolvable material has a room temperature compressive strength of at least about 37 ksi.

31. A tripping ball as claimed in claim 17, wherein the dispersed particles comprise Mg and the adherent dissolvable material has a room temperature shear strength of at least about 20 ksi.

32. A tripping ball as claimed in claim 17, wherein the adherent dissolvable material has predetermined theoretical density and an actual density that is substantially equal to the predetermined theoretical density.

33. A tripping ball as claimed in claim 17, wherein the dispersed particles comprise Mg and the adherent dissolvable material has an actual density of about 1.738 $g/cm^3$ to about 2.50 $g/cm^3$.

34. A tripping ball as claimed in claim 17, wherein the particle core comprises Mg and the adherent dissolvable material is selectably dissolvable at a rate of about 0 to about 7000 $mg/cm^2/hr$.

* * * * *